US005259408A

United States Patent [19]

Guerin

[11] Patent Number: 5,259,408

[45] Date of Patent: Nov. 9, 1993

[54] APPARATUS FOR PROTECTING AGAINST INSECTS

[76] Inventor: François Guerin, Saint-Jean, 97133 Saint-Barthelemy, France

[21] Appl. No.: 872,991

[22] Filed: Apr. 24, 1992

Related U.S. Application Data

[63] Continuation-in-part of Ser. No. 729,142, Jul. 12, 1991, abandoned.

[30] Foreign Application Priority Data

Jul. 12, 1990 [FR] France ..... 90 09126
Nov. 5, 1991 [FR] France ..... 91 13639

[51] Int. Cl.[5] ..... E04H 15/04

[52] U.S. Cl. ..... 135/90; 135/109; 135/112; 5/414

[58] Field of Search ..... 135/90, 95, 97, 98, 135/106, 109, 112, 117; 5/414

[56] References Cited

U.S. PATENT DOCUMENTS

| | | | |
|---|---|---|---|
| 905,660 | 12/1908 | Cowdrey | 5/414 X |
| 1,226,401 | 5/1917 | Smith | 5/414 |
| 1,759,628 | 5/1930 | Pellegrino | 135/90 |
| 2,619,101 | 11/1952 | McGerry et al. | 135/109 X |
| 3,368,575 | 2/1968 | Besonen | 135/109 X |
| 3,744,500 | 7/1973 | Briggs | 135/109 |
| 4,520,835 | 6/1985 | Moeller | 135/109 X |
| 4,836,232 | 6/1989 | De Rosa et al. | 135/109 X |

FOREIGN PATENT DOCUMENTS

| | | | |
|---|---|---|---|
| 441 | 7/1877 | Fed. Rep. of Germany . | |
| 0394020 | 12/1922 | Fed. Rep. of Germany | 5/414 |
| 806506 | 12/1936 | France . | |
| 976500 | 3/1951 | France . | |
| 1050149 | 1/1954 | France . | |
| 0165808 | 7/1921 | United Kingdom | 135/96 |

*Primary Examiner*—Peter M. Cuomo
*Assistant Examiner*—Lan M. Mai
*Attorney, Agent, or Firm*—Larson & Taylor

[57] ABSTRACT

The invention relates to apparatus for providing protection against insects. The apparatus comprises a support device (10), a framework (20) carried by the support device, and netting carried by the framework for the purpose of surrounding a protected zone. The framework comprises a central pivot (22) about which a plurality of arms are capable of pivoting about practically the same axis, said axis being designed to be substantially vertical. The arms (24, 26) can pivot about said axis between a working position in which they are distributed around the axis and a rest position in which they are all placed on the same side of a vertical plane including the pivot. The invention is applicable to mosquito nets.

14 Claims, 4 Drawing Sheets

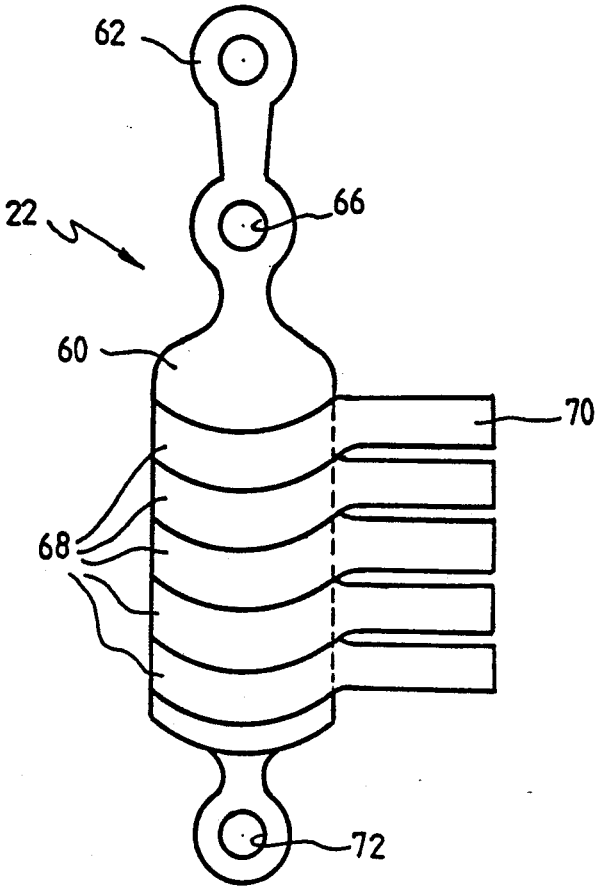
FIG. 6
FIG. 7
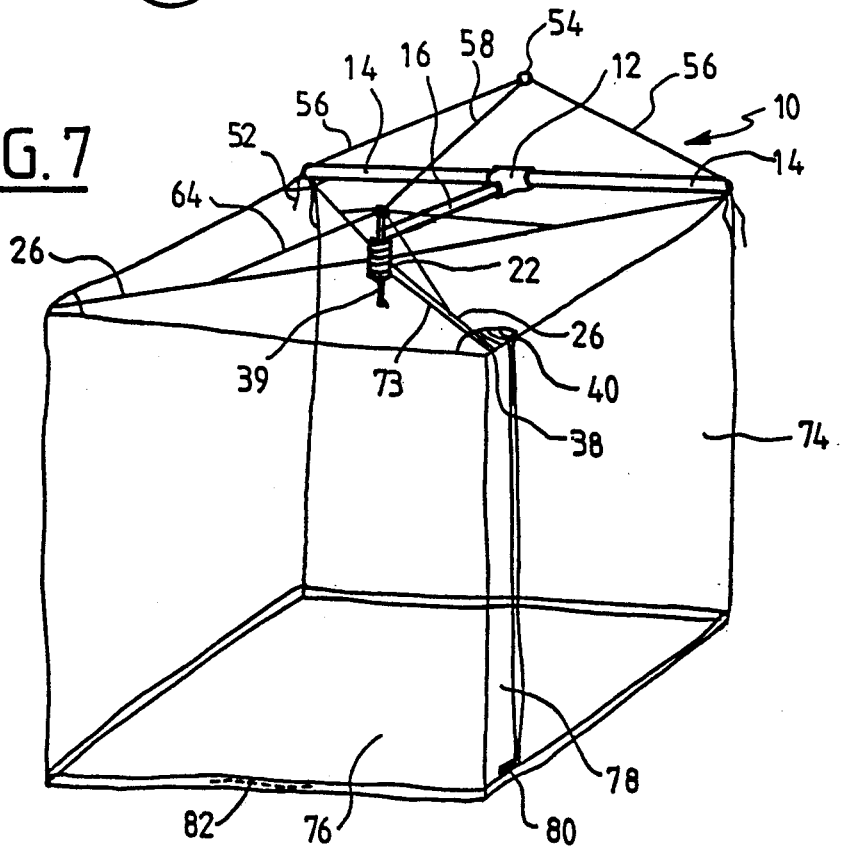

APPARATUS FOR PROTECTING AGAINST INSECTS

This invention is the continuation-in-part of the U.S. patent application Ser. No. 07/729,142 of Jul. 12, 1991, now abandoned.

The invention relates to an apparatus for providing protection against insects, i.e. apparatus including netting, essentially constituted by gauze or by muslin, and carried by a framework which is itself fixed to a wall or to a ceiling. Such apparatuses are already known and they are called "mosquito nets".

BACKGROUND OF THE INVENTION

A variety of mosquito nets having various types of framework are already known. Thus, French patent No. 976 500 describes a mosquito net in which extensible ribs have one end hinged to a slider which is at a distance from a support device when in a closed position. In an open position, after sliding along an upright, the slider is close to the support device and the ribs are received in notches in the support device. Thus by moving in an essentially vertical plane, each rib takes up a position enabling it to support netting.

German patent No. 441 describes hoods for baby carriages, beds, or, baskets including one or two sheets of material each supported by ribs. The ribs are hinged at two locations which are in alignment about a common axis that is always horizontal.

The frameworks of the apparatuses described in the two above-mentioned documents suffer from drawbacks. Thus, in the first case, the netting must be separated from the framework when the framework is to be put into its rest position. The second document describes a framework to which the sheet of material is fixed rigidly since given the rigidity of the framework, it exerts large forces on the sheet of material. In addition, an apparatus having two hinges placed at opposite ends of a space that is enclosed by the sheet of material is unsuitable for use as a mosquito net where the bottom portion of the netting usually rests on the ground or on a bed.

An object of the invention is to provide apparatus for providing protection against insects, which apparatus is particularly simple and robust, and extremely easy to manipulate.

SUMMARY OF THE INVENTION

More precisely, the apparatus of the invention for providing protection against insects comprises a framework including arms that are hinged to enable all of them to pivot substantially in a horizontal plane about a common axis which is substantially vertical. In addition, when the framework has been fixed to a wall by means of a support device, installing netting is extremely simple since the netting is presented beneath the framework and it is easily fixed to its corners and to a central point.

More precisely, the invention relates to an apparatus for providing protection against insects, the apparatus being of the type comprising a support device, a framework carried by the support device, and netting carried by the framework for the purpose of surrounding a protected zone; according to the invention the framework comprises a central pivot from which or in the vicinity of which a plurality of arms are mounted to pivot about an axis that is practically common, said axis being designed to be substantially vertical when the apparatus is disposed in its extended position, and when the apparatus is in said position, the arms can pivot about said axis between a working position in which they are distributed around said axis and a rest position in which they are all disposed on the same side of a vertical plane including the pivot.

Preferably, the central pivot comprises a plurality of parts stacked on one another along the pivot axis, and each having a fitting for engaging the end of a removable arm.

In an embodiment, the framework has four arms that are designed to be adjacent in pairs when the apparatus is in the rest position and to be substantially perpendicular to both adjacent arms when the apparatus is in its working position.

In another embodiment, the framework comprises five arms brought together into two groups when the apparatus is in its rest position, with each of the arms being substantially perpendicular to two other arms when the apparatus is in its extended position, and with two arms from two different groups lying adjacent each other when the apparatus is in its extended position.

The framework is preferably dismountable, in which case it is advantageous for at least some of the arms to be telescopic so that the apparatus is reduced in size when it is dismounted.

Most advantageously, the netting has a top portion designed to extend substantially horizontally and a plurality of walls designed to be substantially vertical, with the top portion of the netting being made of cloth that has good dimensional stability, and with the walls being made of gauze or muslin. Preferably, the top portion of the netting is made of cloth which shrinks only negligibly when washed. In addition, it is advantageous for the top portion of the netting to be made of a cloth which is sufficiently opaque to prevent the framework being visible therethrough.

The top portion of the netting is preferably polygonal in shape, having the same number of corners as there are arms, with each corner having a gusset on top that is open towards the center for the purpose of receiving the end of an arm when the apparatus is in its operating position.

Advantageously, the top portion of the netting is fixed in the middle to the central pivot of the framework.

In an embodiment, the top portion of the netting is polygonal in shape, it is split along a line going from its center to one of its edges, its center carries a device for fixing to the pivot of the framework, and the two sides of the split in the top portion overlap each other. Under such circumstances, the two sides of the split are preferably fixed together when the apparatus is in its extended position. Such fixing is preferably provided by a press-fastener or by fabrics having complementary hooks and loops.

The device for fixing the central portion of the top portion of the netting preferably comprises a cord for knotting to the central pivot.

In an advantageous embodiment, at least one of the walls comprises two flaps that overlap and that are suitable for being moved apart while entering or leaving the apparatus.

It is advantageous for at least two adjacent walls each to possess two flaps that overlap and that can be moved apart, and for the netting to carry a tape at an intermediate height where the walls meet each other, with the tape serving to hold one of the flaps of each of the two adjacent walls to the rear wall and to form a curtain loop. The front corners preferably have fasteners so that the walls of the netting can be raised and when the tape and the fasteners are in use, the apparatus takes up the form of a canopy.

In some embodiments, the bottom portions of the walls of netting are weighted or ballasted.

It is advantageous for the support device of the framework to include an additional rigid arm secured to the central pivot and intended to be held perpendicular to the wall from which the apparatus is suspended.

BRIEF DESCRIPTION OF THE DRAWINGS

Other characteristics and advantages of the invention appear more clearly from the following description which is given with reference to the accompanying drawings, in which:

FIG. 6 shows the central pivot of the framework on a larger scale; and

FIG. 7 shows a mosquito net constituting another embodiment of the invention.

MORE DETAILED DESCRIPTION

Figure 1:
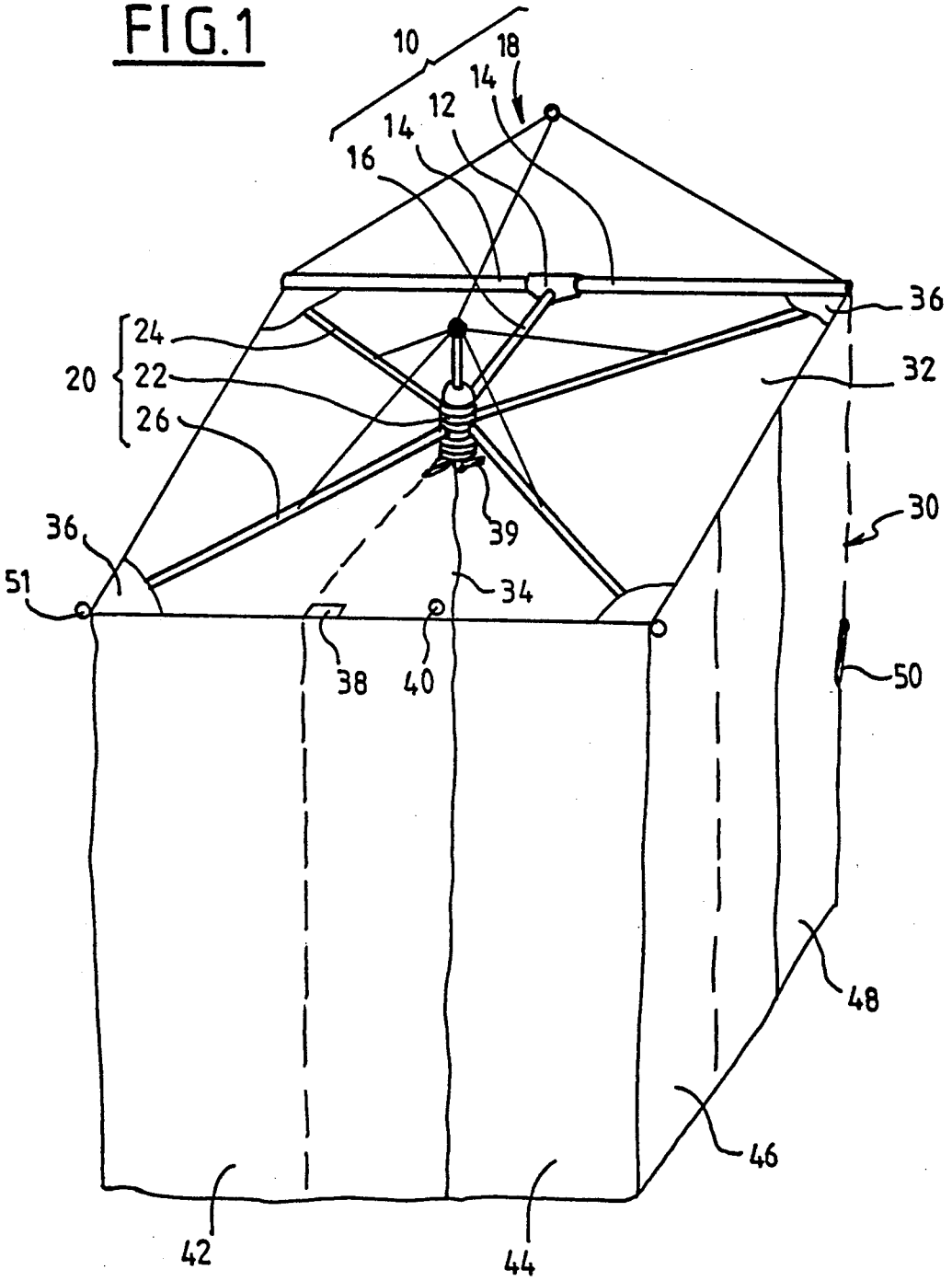
FIG. 1 is a perspective view of an apparatus of the invention in the form of a mosquito net shown as seen looking down from slightly above to show details of the framework clearly.

The apparatus shown in FIG. 1 for providing protection against insects is intended to be fixed to a wall above the head of a bed. The apparatus essentially comprises a support device given overall reference 10. The support device comprises: an interconnecting nut 12 having a plurality of arms projecting therefrom; two horizontal arms 14 for placing horizontally against a wall; a horizontal arm 16 for projecting forwards to support the framework; and a set 18 of stays for fixing to the wall.

The apparatus also includes a netting support framework. The framework is given an overall reference 20 and essentially comprises a central pivot 22 carried at the projecting end of the arm 16 of the support device, and four arms: two back arms 24 and two fronts arms 26. In this embodiment, the framework has four arms whose tips define a quadrilateral, e.g. a square having a side of about 2.1 meters (m).

The nut 12 and the pivot 22 which are described in greater detail below in the present description are essentially made of plastic, whereas the various arms 14, 16, 24, and 26 are made of bamboo or of extruded plastic tubing. It is also possible for them to be in the form of members that are optionally telescopic.

The apparatus shown in FIG. 1 also includes netting given an overall reference 30. According to an advantageous characteristic of the invention, the netting 30 essentially comprises walls, and a top portion 32 made of a different material. In the embodiment of FIG. 1, the top portion 32 is split between its center and an intermediate portion of its front edge, and the split is provided with two overlapping edges. These edges can be fixed together by fixing devices given references 38 and 40 which may be constituted, for example, by a fixing device 38 comprising fabric with loops and with hooks, and a press-fastener device 40. In a variant, the top portion 32 is not split in this way and the apparatus then needs to be folded in a special manner as described in detail below. It may also be observed that each of the corners of the top portion 40 includes a patch constituting a gusset 36 sewn onto each corner so as to form a pocket enabling the netting to be fixed to the ends of the arms 24 and 26.

Advantageously, the top portion 32 is made of a non-seethrough cloth that is practically opaque, and that has high dimensional stability. Such dimensional stability makes it possible to install the netting 30 on the framework 20 merely by inserting the ends of the arms 24, 26 into the corner pockets 36 with a central cord 39 being fixed to the bottom of the pivot 22. It is therefore desirable for the top portion 32 to be made of a cloth that is stable on being washed, i.e. that does not shrink by more than 3%, for example. A suitable cloth for this purpose is 50% polyester and 50% cotton.

Figure 2:
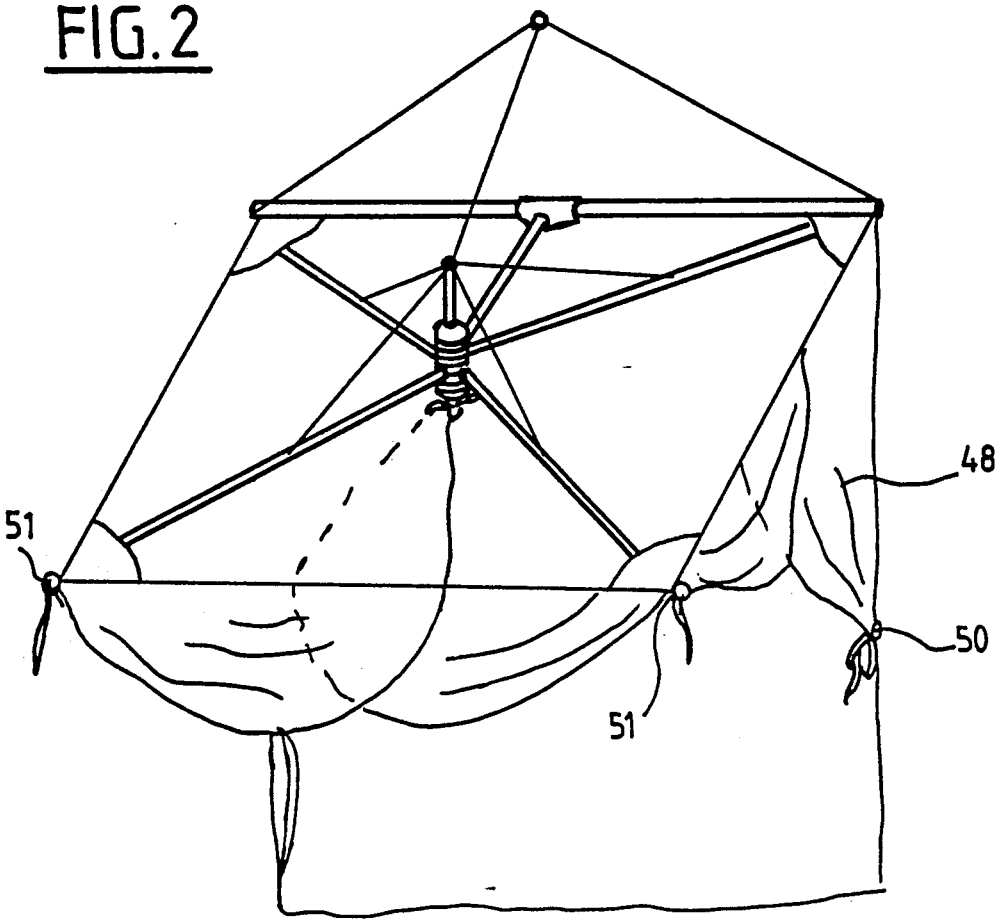
FIG. 2 is a view similar to FIG. 1, but in which the cords of the netting are in used to put the apparatus in a canopy-shaped disposition.

The front wall (in FIG. 1) and the side walls of the netting 30 are each constituted in an advantageous embodiment by two flaps of gauze or muslin, namely flaps 42 and 44 for the front face and flaps 46 and 48 for the side face that is visible in FIG. 1. These flaps overlap considerably as can be seen in the figure. The adjacent flaps 44 and 46 of two adjacent walls are preferably constituted by a single piece of gauze or muslin. Where the side walls meet the back walls, a tie-back cord 50 is sewn on about half-way up to enable the adjacent side flaps to be held back like a curtain loop as shown in FIG. 2. In addition, internal cords and external loops form fasteners 51 (see FIG. 2) on each of the two front corners for supporting the netting.

FIG. 2 shows the apparatus of FIG. 1 in which the cords 50 and the fasteners 51 are in use for retaining adjacent flaps such as 44 and 46. In this disposition, the apparatus forms a canopy giving an overall appearance similar to that of a four-poster bed. It does not provide protection against insects, but it does provide very easy access to a bed placed beneath the framework. It should be observed that because of the openings formed in each of the walls and because of the overlap between pairs of adjacent flaps such as 42, 44 and 46 and 48, it is very easy to get into the bed placed within the apparatus shown in FIG. 1.

Figure 3:
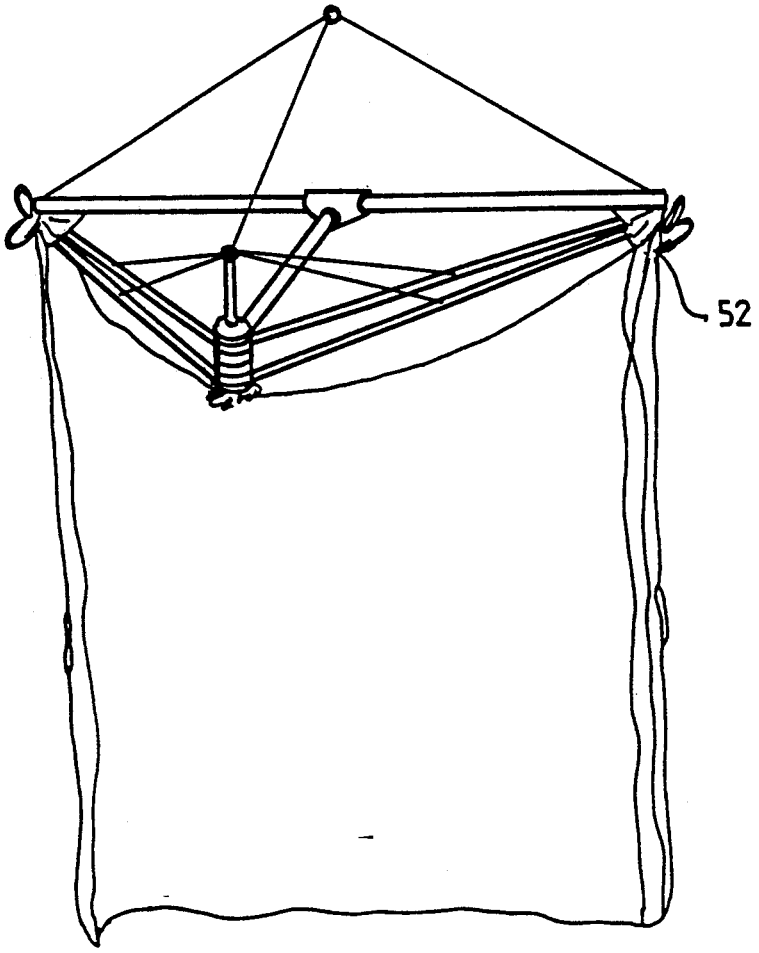
FIG. 3 is analogous to FIGS. 1 and 2, showing the framework and the mosquito net in a rest position.

FIG. 3 shows a rest position for the apparatus in which the framework has been folded, as described below in greater detail with reference to FIGS. 4 and 5, with the flaps of the netting being retained at the corners of the framework and of the support device by additional cords 52 sewn onto the back corners of the netting.

Figure 4:
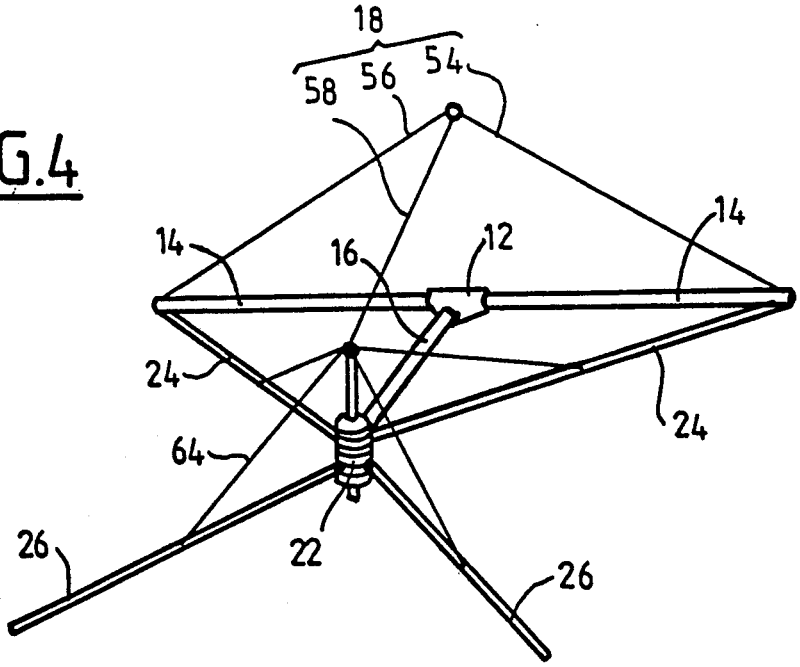
FIG. 4 shows the framework of the apparatus of FIGS. 1 and 2 in its extended position.

FIG. 4 shows the framework of the apparatus of FIGS. 1 and 2 as it appears when no netting is installed on the framework. Additional references are used to designate the top member 54 for fixing the support device to a wall, and also serving to secure the stays 56 which hold the ends of the horizontal arms 14 of the support device, and a stay 58 which supports the top of the central pivot 22 of the framework, said stays constituting portions of the set 18.

Figure 5:
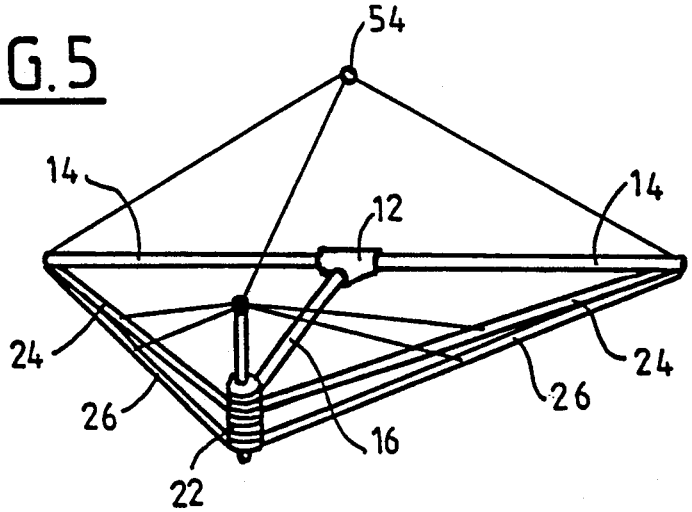
FIG. 5 shows the framework of FIG. 4 in its rest position.

FIG. 5 shows that the rest position of the framework (already shown in FIG. 3) may be obtained easily, merely by pivoting the two arms 26 through one-fourth of a turn about the vertical axis central pivot 22.

The central pivot on which the arms are mounted is an essential component of the protection apparatus of the invention. Although it may be made in various different ways, the embodiment shown in FIG. 6 is particularly convenient for ensuring that the arms 24 and 26 can pivot in a plane that is substantially horizontal about an axis that is common or nearly common and that is vertical. It comprises firstly a top portion 60 which is terminated at the top by an eye 62 for fixing to the stay 58 and to optional stays 64 (see FIG. 4) supporting the middles of the arms 24 and 26. The top portion 60 of the pivot has a hole 66 for receiving the tip of the arm 16 of the support device. A plurality of washers 68 are then stacked beneath the top portion 60. Each washer has a cylindrical body of circular section capable of pivoting about the pivot axis 22 and including a fitting 70 suitable for engaging the end of one of the arms 24, 26. FIG. 6 shows five washers 68 suitable for engaging five arms. In the embodiment shown in FIGS. 1 to 5, four washers suffice. However, in the embodiment shown in FIG. 7, five washers are used for supporting five arms. Finally, the pivot 22 includes a bottom portion forming an eye 72 for fixing to the central cord 39 of the top portion 32 of the netting.

The apparatus shown in FIGS. 1 to 6 is very easily dismounted and put away. The netting is removed by undoing the cord 39 and by extracting the arms from the pockets 36. The netting can then be folded. The framework is then dismounted by extracting the pivot 22 from the end of the arm 16 of the support device and by extracting each of the arms 24 and 26. The support device is then itself dismounted by separating the arms 14, 16, and 18 from the nut 12. All of the arms, the nut, and the pivot can easily be bundled together in a small volume. The arms 14 and 16 are about 1.1 m long. The arms 24 and 26 are about 1.5 m long. If this length is considered to be too long, then each of the arms 24 and 26 may be telescopic.

For installation, the support device and the framework are assembled by the opposite procedure, until they take up the disposition shown in FIG. 4. Thereafter, the top of the netting 32 is presented beneath the framework. The corner pockets 36 are fitted in succession over the ends of the arms 24 and 26, and the central cord 39 is fastened to the pivot 22. The side walls then hang naturally.

FIG. 7 shows a variant apparatus of the invention. The support device is analogous to that shown in FIGS. 1 to 5. Similarly, the framework is very similar to that of FIGS. 1 to 5 apart from the fact that it includes an additional arm 73 analogous to the arms 26. More precisely, in this embodiment, the walls of the netting, now referenced 74, are continuous and the split enabling the netting to be opened is formed at one of the corners between two walls. This corner corresponds to two of the arms 26 and 73 being juxtaposed, one of them carrying the corner of the wall 74 and the other carrying the corner of a front wall 76. An overlap flap 78 extends the front wall netting 76 and is fixed to the top portion or to the side wall 74 by fixing devices referenced 38 and 40 since they may be analogous to those used in the first embodiment. An additional bottom fixing device 80 may also be placed at the bottom. In this embodiment, optional ballasting 82 is shown in the bottom portions of the walls such as 74 and 76.

The second embodiment forms a structure that can be closed more thoroughly than the structure shown in FIGS. 1 to 3. However, it is more difficult of access.

In the various embodiments, the openings obtained with overlapping flaps such as 42, 44 in FIG. 1 may be used at one or more corners in one or more walls, in any convenient combination.

When the top portion 32 of the netting has a split as referenced 34 in FIG. 1, going from the position shown in FIG. 1 to that shown in FIG. 3 is very simple since it suffices merely to pivot the arms 26. However, if the top portion 32 is made in one piece, folding the arms from the position shown in FIG. 4 to the position in FIG. 5 requires the end of one of the front arms to be removed from a pocket 36, the arms to be folded, and then the pocket to be fixed back onto the front arm. This small difficulty is usually acceptable, particularly in the embodiment of FIGS. 1 and 2 since while it is in use the framework retains its extended position and only the flaps such as 44 and 46 are tied back by the cords 50 and 51 or are moved towards one another.

In the embodiments described above, the netting delimits a rectangular volume that is nearly in the form of a cube with a side that is advantageously about 2.1 m long. However, other dispositions are possible. For example, there is no need for all of the walls to be the same size, in particular when the apparatus is for protecting a single bed. Under such circumstances, the arms 24 and 26 may be the same size or they may be of different sizes. For example, the forwardly-extended arms 26 may be longer than the backwardly-extending arms 24. Under such circumstances, when the apparatus is in the extended position, the two arms 24 and 26 on the same "diagonal" are not exactly in line.

Although the protection apparatus described is square or rectangular in section, other polygonal sections could be envisaged. For example, a substantially circular zone could be protected by using netting whose section in a horizontal plane is that of a polygon (preferably a regular polygon). For example, the pivot 22 could have six washers 68 and the framework could have six arms supporting the six corners of a hexagonal top portion.

The embodiments described above are made of materials that are relatively cheap. For example, the pivot 22 which is the most complicated part is made of a plastic such as Nylon, as is the nut 12. The various arms may be made of bamboo. Consequently, the protection apparatus is cheap in spite of being robust and convenient to use.

The support device may have other dispositions including more arms or fewer, providing it holds the pivot 22 at a distance from a wall. In particular, instead of having a single fixing point on the wall (at 54), it may have a plurality of such fixing points, in particular at locations corresponding to the outermost tips of the arms 14.

I claim:

1. An apparatus for providing protection against insects, the apparatus comprising a support device in combination with a wall the support device comprising a rigid arm, a framework carried by the support device, and a netting carried by the framework, the framework comprising a central pivot attached to a first end of the rigid arm, the pivot having a plurality of arms mounted thereon for pivoting about a common axis extending through the central pivot, the axis being substantially parallel to and the rigid arm being perpendicular to a wall to which the apparatus is attached when the apparatus is disposed in an operating position, the plurality of arms being capable of pivoting about the axis between a working position in which the plurality of arms are distributed around the axis and a rest position in which the plurality of arms are all disposed on one side of a vertical plane extending through the axis.

2. The apparatus according to claim 1 wherein the central pivot comprises a plurality of parts stacked on one another along the common axis, each of the parts having a fitting for engaging an end of one of the plurality of arms.

3. The apparatus according to claim 1 wherein the plurality of arms comprises two front arms and two back arms.

4. The apparatus according to claim 3 wherein, in the rest position, each of the front arms is rotated about the central pivot to a position substantially directly above or below an adjacent back arm.

5. The apparatus according to claim 3 wherein, in the working position, adjacent front and back arms are substantially perpendicular to one another in a plane perpendicular to the common axis.

6. The apparatus according to claim 1 wherein the netting comprises a front wall, two side walls and a back wall, the walls defining an enclosed interior space, the back wall being adjacent a wall to which the support device is attached when the apparatus is disposed in an operating position.

7. The apparatus according to claim 6 wherein at least one of the front and two side walls comprise two overlapping flaps which, when separated, provide access to the interior space.

8. The apparatus according to claim 1 wherein the support device further comprises at least one additional arm perpendicular to the rigid arm and connected to a second end of the rigid arm opposite the first end, the additional arm being substantially adjacent a wall to which the apparatus is attached when the apparatus is disposed in an operating position.

9. The apparatus according to claim 1 wherein the support device further comprises a set of stays for attaching the apparatus to a wall.

10. An apparatus for providing protection against insects, the apparatus comprising a support device, a framework carried by the support device, and a netting carried by the framework, the netting comprising a front wall, two side walls and a back wall, the walls defining an enclosed interior space, the back wall being adjacent a wall to which the support device is attached when the apparatus is disposed in an operating position, each of the front and the two side walls comprising two flaps, adjacent side and front wall flaps comprising a single piece of material, a portion of each of the flaps being overlapping over a central portion of each of the front and side walls, the framework comprising a central pivot having a plurality of arms mounted thereon for pivoting about a common axis extending through the central pivot, the axis being substantially parallel to a wall to which the apparatus is attached when the apparatus is disposed in an operating position, the plurality of arms being capable of pivoting about the axis between a working position in which the plurality of arms are distributed around the axis and a rest position in which they are all disposed on one side of a vertical plane extending through the axis.

11. The apparatus according to claim 10 wherein the netting further comprises fastening means for holding open the front and side walls, whereby, in the working position, the netting has an appearance of a canopy bed.

12. The apparatus according to claim 1 wherein the netting further comprises a top portion attached to the front, back and two side walls.

13. The apparatus according to claim 12 wherein the top portion of the netting is made from a cloth of sufficient opacity to conceal the framework when the apparatus is viewed from a position outside the interior portion.

14. The apparatus according to claim 10 wherein the netting is made from a gauze or muslin material.

* * * * *